US005967944A

United States Patent [19]

Vittone et al.

[11] Patent Number: 5,967,944

[45] **Date of Patent: *Oct. 19, 1999**

[54] CROSS-TRAINING EXERCISE APPARATUS

[76] Inventors: Larry W. Vittone; Suzanne R. Vittone, both of Rt. 1, Box 55, Hurley, Wis. 54534

[ * ] Notice: This patent is subject to a terminal disclaimer.

[21] Appl. No.: 09/020,641

[22] Filed: Feb. 9, 1998

Related U.S. Application Data

[63] Continuation-in-part of application No. 08/692,437, Aug. 5, 1996, Pat. No. 5,735,773.

[51] Int. Cl.[6] ..... A63B 69/16; A63B 21/00

[52] U.S. Cl. ..... 482/52; 482/51; 482/62; 482/37

[58] Field of Search ..... 482/51, 52, 53, 482/70, 71, 74, 148, 58, 79, 37

[56] References Cited

U.S. PATENT DOCUMENTS 5,039,088 8/1991 Shifferaw ..... 482/51
5,735,773 4/1998 Vittone et al. ..... 482/52

*Primary Examiner*—Stephen R. Crow
*Attorney, Agent, or Firm*—Michael E. McKee

[57] ABSTRACT

A cross-training exercise apparatus includes a base, a pair of foot supports pivotally and slidably joined to the base by way of a linkage assembly interposed between each foot support and the base. Each linkage assembly accommodates a pivotal movement of a corresponding foot support relative to the base between forward and rearward positions and accommodates a movement of each foot support relative to the base between raised and lowered positions. The exercise apparatus also includes a pair of cable and pulley arrangements which are associated with the base and joined between the foot supports for coordinating the movement of the foot supports between forward and rearward positions or between upward and downward positions so that movement of one foot support relative to the base effects a corresponding movement of the other foot support relative to the base.

18 Claims, 7 Drawing Sheets

CROSS-TRAINING EXERCISE APPARATUS

This is a continuation-in-part application of application Ser. No. 08/692,437, filed Aug. 5, 1996 now, U.S. Pat. No. 5,735,773, the disclosure of which is incorporated herein by reference.

BACKGROUND OF THE INVENTION

This invention relates generally to exercise equipment and more particularly is concerned with exercise apparatus which involves the movement of two feet of a user in an alternating fashion during use of the apparatus.

For example, one exercise apparatus with which this invention can be compared is a stair-climbing apparatus wherein the feet are alternately raised from a lowered position so that when one foot is in an elevated position, the other foot is in a lowered position, and vise-versa. Another exercise apparatus with which this invention can be compared is a cycle-type exercise device wherein the feet of a user are used to forcibly rotate cranks about a horizontal axis of rotation and the feet are positioned at diametrically-opposed locations relative to the axis of rotation. Consequently, when one foot of the user forces a corresponding pedal of the crank downwardly, the other pedal of the crank lifts the other foot of the user upwardly.

Another exercise apparatus with which this invention can be compared is a ski-type exercise device having a frame and a pair of feet-supporting skis slidably mounted upon the frame for movement in forward and rearward directions relative thereto. During use of the ski-type exercise device, one foot of the user is urged rearwardly relative to the frame while the other foot of the user is shifted forwardly relative to the frame.

It is an object of the present invention is to provide a new and improved exercise apparatus involving alternating movements of the feet of the user during use of the apparatus.

Another object of the present invention is to provide such an apparatus wherein a user may selectively simulate cycling movements, stair-climbing movements, skiing movements, running movements or walking movements.

Yet another object of the present invention is to provide such an apparatus for exercising the arms, as well as the legs, of a user during an exercise routine.

Still another object of the present invention is to provide such an apparatus including two foot supports capable of being moved along elliptical and/or circular paths and wherein the movements of the foot supports along the permitted paths of movement are coordinated with one another.

One more object of the present invention is to provide such an apparatus which is uncomplicated in construction and effective in operation.

SUMMARY OF THE INVENTION

This invention resides in an exercise apparatus having a base having a front and a pair of foot supports joined to the base in a manner which accommodates a movement of each foot support relative to the base between forward and rearward positions and which accommodates a movement of each foot support relative to the base between raised and lowered positions. Coordinating means are associated with the base and joined between the foot supports for coordinating the movement of the foot supports between forward and rearward positions so that movement of one foot support relative to the base in one of a forward and rearward direction effects a corresponding movement of the other foot support relative to the base in the other of the forward and rearward direction and for coordinating the movement of the foot supports between raised and lowered positions so that movement of one foot support relative to the base in one of an upward and downward direction effects a corresponding movement of the other foot support relative to the base in the other of the upward and downward direction.

The coordinating means includes a first cable and pulley arrangement joined between the base and the foot supports for coordinating the movement of the foot supports between forward and rearward positions as aforesaid and further includes a second cable and pulley arrangement joined between the base and the foot supports for coordinating the movement of the foot supports between the raised and lowered positions as aforesaid.

DETAILED DESCRIPTION OF THE ILLUSTRATED EMBODIMENTS

Figure 1:
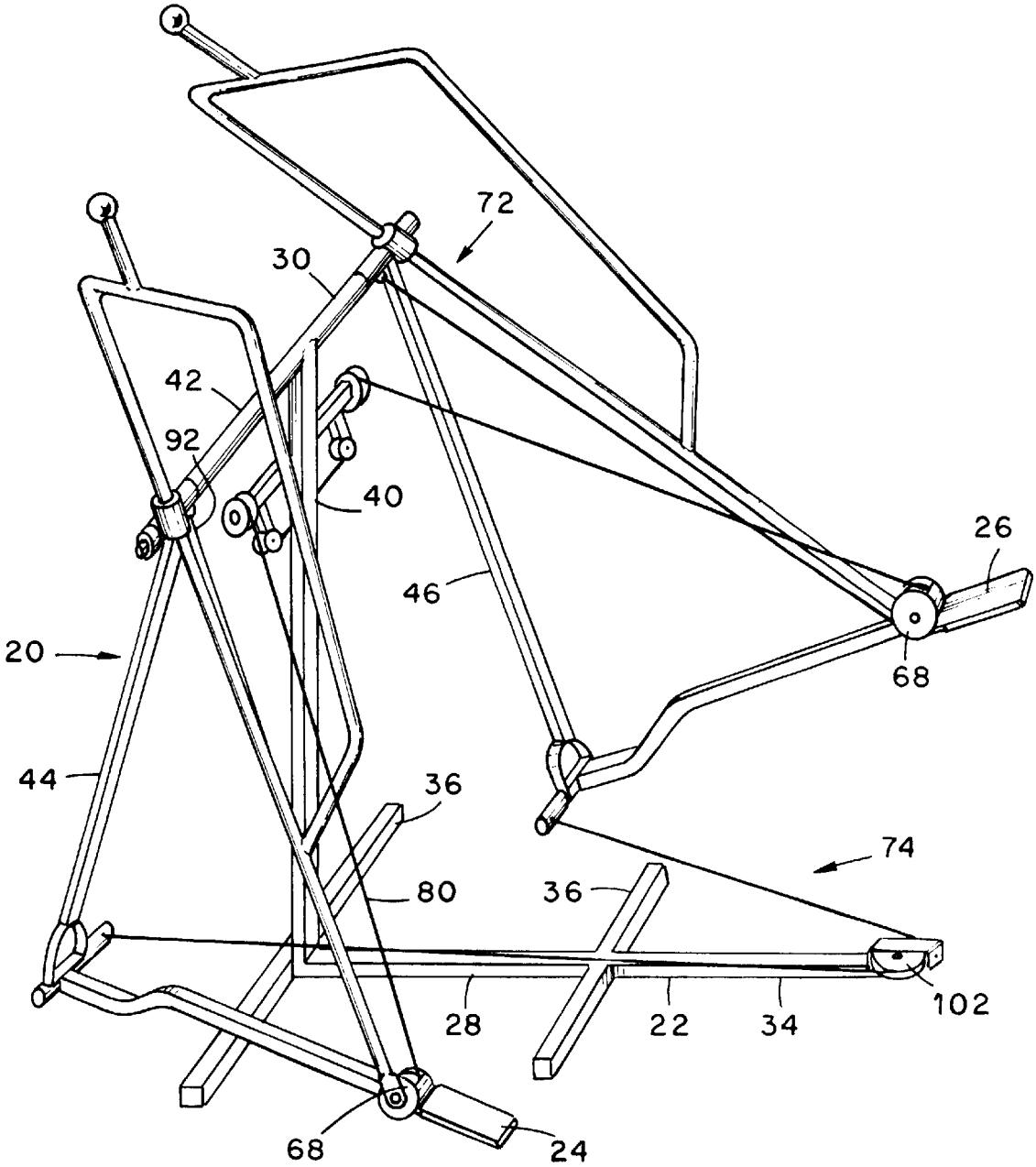
FIG. 1 is a perspective view of an apparatus within which features of the present invention are embodied.

Turning now to the drawings in greater detail, there is shown in FIG. 1 an embodiment, generally indicated 20, of a cross-training exercise apparatus within with features of the present invention are incorporated. The embodiment 20 includes a base 22 and a pair of left and right foot supports 24 and 26, respectively, which are connected to the base 22 by way of linkage assemblies (described herein) so that the each foot support 24 or 26 is movable relative to the base 22 in a substantially vertically-oriented plane to accommodate the movement of the foot support 24 or 26 through any of a number of positions in that vertical plane. In addition, the foot supports 24, 26 are connected to one another so that the movement of each foot support 24 or 26 within its vertical plane is coordinated with that of the other foot support 26 or 24. For example, as one foot support 24 or 26 is forcibly moved downwardly relative to the base 22, the other foot support 26 or 24 is forcibly moved upwardly relative to the base 22. During use of the apparatus 20, a user stands with his feet upon the foot supports 24 and 26 and, while holding onto appropriate grips of the apparatus 20, moves his feet (and appropriately shifts his weight) to simulate any of a number of exercise motions, such as cycling, skiing, walking, jogging or stair-climbing, while the foot supports 24 and 26 move accordingly in response to the motions of the feet.

Figure 2:
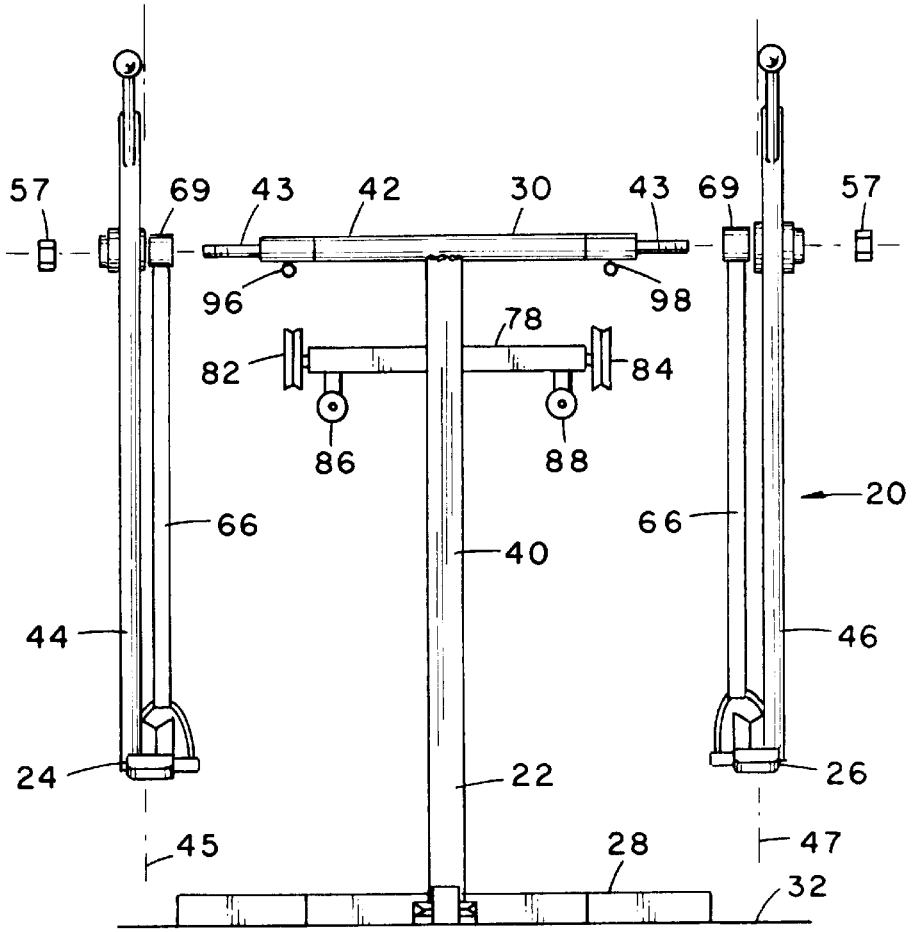
FIG. 2 is a rear view of various components of the FIG. 1 apparatus as seen generally from the right in FIG. 1 and shown exploded.

With reference to FIGS. 1 and 2, the base 22 of the apparatus 20 includes a lower section 28 adapted to rest upon a floor 32 or similar (i.e. upwardly-facing) support surface and an elevated section 30 joined to the lower section 28. As best shown in FIG. 1, the lower section 28 includes a main bar 34 which extends in a forward and rearward direction relative to the remainder of the base 22 and a pair of parallel cross members 36 and 38 joined to the main bar 34 in a spaced relationship with one another so that the cross members 36 and 38 and bar 34 collectively define a plane, and this planar relationship defined by the components of the lower section 28 permits the base 22 to rest flatly upon the floor 32 and to stably support the apparatus 20 during use.

The elevated section 30 includes a post 40 which is joined to the lower section 28 by way of the main bar 34 thereof so as to extend generally upwardly therefrom along a substantially vertical path and a horizontally-extending member 42 fixedly joined atop the post 40 at a location disposed substantially midway along the length of the member 42. As best shown in FIG. 2, each end of the member 42 is directed away from a corresponding side of the apparatus 20 and includes a cylindrical end portion 43 of reduced diameter and whose purpose will become apparent herein. Each bar-like component of the elevated section 30, as well as those of the lower section 28, is comprised of a suitable material, such as steel, and is fixedly secured to an adjacent component, as with welds.

Figure 3:
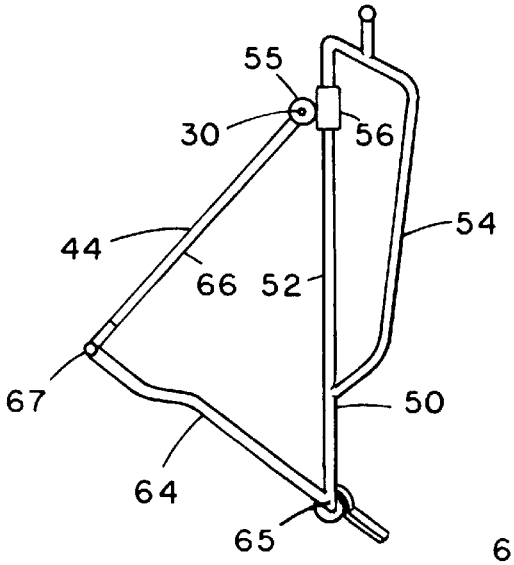
FIG. 3 is a side view of one three-member linkage arrangement of the FIG. 1 apparatus showing its components in one position relative to one another.
Figure 4:
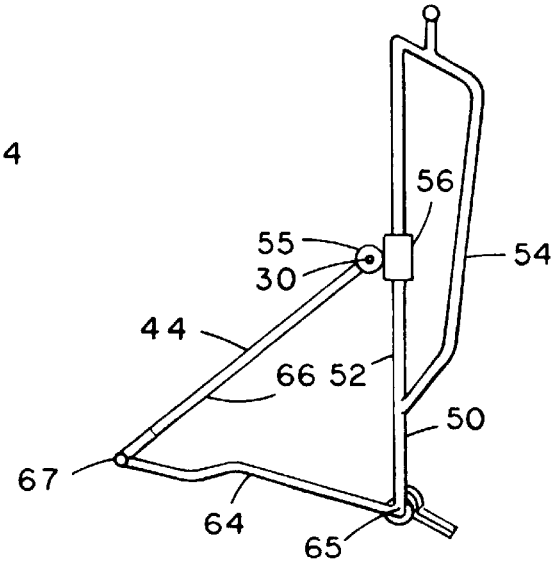
FIG. 4 is a side view of the three-member linkage arrangement illustrated in FIG. 3 showing its components in another position relative to one another.
Figure 5:
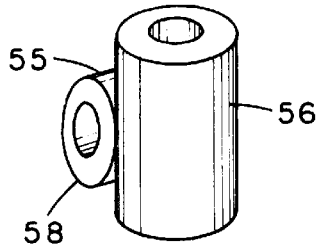
FIG. 5 is a perspective view of a connector member of the FIG. 1 apparatus.
Figure 6:
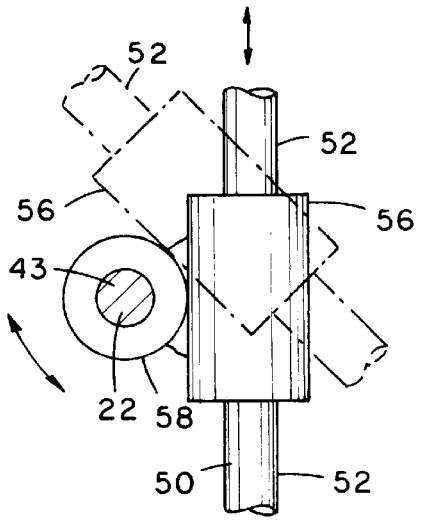
FIG. 6 is a side elevational view of the connector member of FIG. 5 shown attached to the base.

With reference to FIGS. 2–4, the apparatus 20 includes left and right linkage assemblies 44 or 46, respectively, interposed between the foot supports 24 and 26 the base 22. Each of these linkage assemblies 44, 46 is joined to a corresponding end portion 43 of the elevated section 30 of the base 22 to accommodate a rotational, as well as sliding, movement of the foot support 24 to 26 relative to the elevated section 30. To this end and as exemplified by the linkage assembly 44 of FIGS. 3 and 4, each linkage assembly 44 or 46 includes a first elongated member in the form of an arm 50 having a linear section 52 and a somewhat arcuate-shaped grip section 54 joined at its opposite ends to the linear section 52. The arm 50 is pivotally and slidably connected to the elevated section 30 by way of a connector member 55 (best shown in FIGS. 5 and 6) including a first collar portion 56 which is slidably positioned about the linear section 52 (and captured between the ends of the grip section 54) and a second collar portion 58 which is fixedly joined to the first collar portion 56 in an orthogonal relationship therewith. The second collar portion 58 is positionable upon a corresponding end section 43 (FIG. 2) of the elevated base section 30 and is rotatable with respect thereto so that the connector member 55 enables the arm 50 to be pivoted relative to the end section 43 (by way of the second collar portion 58) and to be slidably moved relative to the end section 43 (by way of the first collar portion 56).

With reference again to FIGS. 3 and 4, each linkage assembly 44 or 46 further includes a second elongated member in the form of a bar 64 which is pivotally secured at one end to the arm 50 and a third elongated member in the form of a bar 66 which is pivotally secured at its lower end to the end of the bar 64 opposite the arm 50 and is rotatably secured at its upper end to the end section 43 of the elevated section 30 of the base 22. The arm 50 is pivotally joined to the rearward end of the bar 64 by means of a pivot pin 65 which extends through aligned openings provided in the corresponding ends of the arm 50 and bar 64, and the forward end of the bar 64 is pivotally joined to the lower end of the bar 66 by means of a pivot pin 67 which extends through aligned openings provided in the corresponding ends of the bars 64 and 66. A collar section 69 is fixedly joined to the bar 66 adjacent its upper end and is positionable about the end section 43 of the elevated section of the base 22 to accommodate the rotation (i.e. pivoting) of the bar 66 relative to the base 22 between alternative angular positions. Each collar section 68, as well as a corresponding connector member 55, is secured upon its corresponding end section 43 by way of a nut 57 which is threadably secured upon the end section 43.

It follows from the foregoing that the bar 66 is connected to the arm 50 of each linkage assembly 44 or 46 by way of the end section 43 and connector member 55. In other words, because the bar 66 is pivotally secured to the end section 43 by way of the collar 69 and because the arm 50 is pivotally and slidably secured to the end section 43 by way of the connector member 55, the arm 50 and bar 66 are pivotally and slidably connected to one another.

It also follows from the foregoing that each linkage assembly 44 or 46 provides a three-member linkage arrangement whose components (i.e. arm 50 and bars 64 and 66) have ends which are joined to the ends of the other components of the assembly 44 or 46 so that relative movement between two of these components effects a corresponding movement of the remaining component. As can be seen in the comparative views of FIGS. 3 and 4, the movement of one of the components 50, 64 or 66 relative to the end section 43 of the base 22 effects a shift in position between the other components 50, 64 or 66 relative to the end section 43, and the permitted movement between the components 50, 64 and 66 permits the corresponding foot support 24 or 26 to be positioned in any of a number of positions in its corresponding vertical plane 45 or 47.

Each foot support 24 or 26 is in the form of a platen-like member capable of supporting the weight of the user as the user's feet are positioned thereon and is rigidly joined to the bar 64 so as to extend rearwardly thereof. Consequently, each foot support 24 or 26 is moved in conjunction with movement of the bar 64 to which it is secured. Preferably, each foot support 24 or 26 is covered with a rubberized, or other high-friction material, to reduce the likelihood of slip between the foot support 24 or 26 and the foot of a user positioned thereon.

With reference again to FIG. 1, the apparatus 20 also includes means, generally indicated 70, for coordinating the movement of the foot supports 24 and 26 relative to one another as the foot supports 24, 26 are moved in their corresponding vertical plane 45 or 47 (FIG. 2). To this end, the coordinating means 70 includes a first coordinating means, generally indicated 72, for coordinating the permitted vertical (i.e. upward and downward) movement of the foot supports 24 and 26 relative to the base 22 and a second coordinating means, generally indicated 74, for coordinating the permitted fore and aft (i.e. forward and rearward) movement of the foot supports 24, 26 relative to the base 22.

Figure 7:
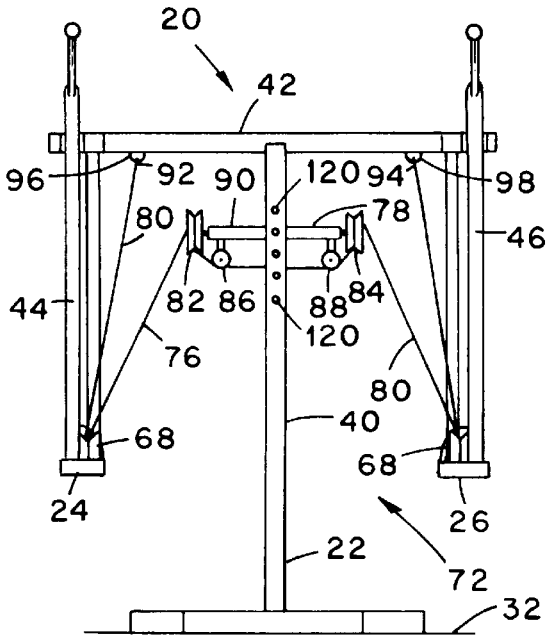
FIG. 7 is a rear elevational view of the FIG. 1 apparatus showing its linkage assemblies when in one position relative to the base.
Figure 8:
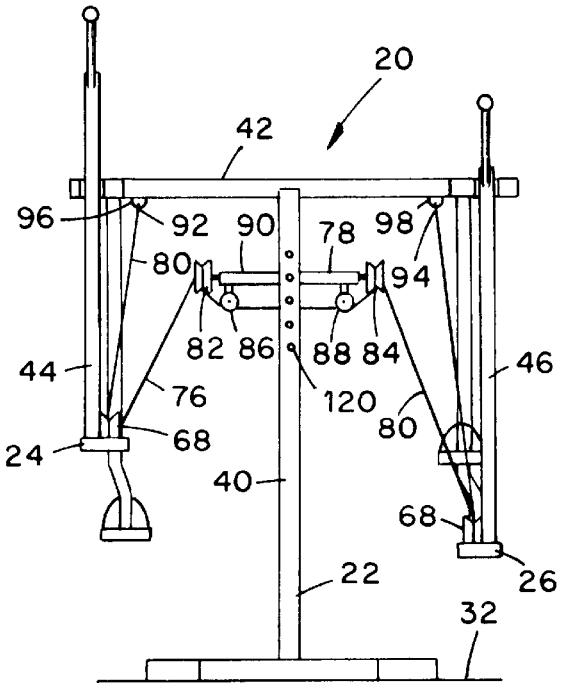
FIG. 8 is a view similar to that of FIG. 7 wherein the apparatus is shown with its linkage assemblies in another position relative to the base.

As best shown in FIGS. 7 and 8, the first coordinating means 72 includes a tension assembly 76 including a first cable and pulley arrangement comprising a pair of pulleys 68, a pulley assembly 78 an a cable 80. Each pulley 68 is journaled to the bar 64 adjacent the corresponding foot support 24 or 26 for rotation about a horizontal axis, and the pulley assembly 78 includes four pulleys 82, 84, 86 and 88 which are journaled to a support bar 90 which is, in turn, affixed to the post 40 of the base 22 adjacent the horizontal member 42. Two pulleys 82 and 84 are arranged in substantially parallel relationship at the opposite ends of the bar 90 for rotation about coincident axes, and each of the other two pulleys 86 and 88 is supported from the bar 90 (and generally beneath a corresponding pulley 82 or 84) for rotation about substantially horizontal and parallel axes.

The cable 80 has two opposite ends 92 and 94 which are fixedly secured, or anchored, to the horizontal member 42 of the base 22 by way of the U-brackets 96 and 98 positioned adjacent the corresponding ends of the bar 42. As the cable 80 is traced from its end 92 toward its end 94, the cable 80 is routed in sequence through one pulley 68, across the pulleys 82, 86, 88 and 84 of the pulley assembly 78, and then through the other pulley 68. With the cable ends 92 and 94 anchored to the member 42 in this manner, the foot supports 24 and 26 are suspended by the cable 80 above the floor 32. consequently, the downward movement of a selected one of the foot supports 24 or 26 by, for example, a shift of the user's weight toward the side of the apparatus 20 corresponding to the selected foot support 24 or 26 effects the forced upward movement of the other foot support 26 or 24. Similarly, the downward movement of the other foot support 26 or 24 by, for example, a shift of the user's weight toward the side of the apparatus 20 corresponding to the other foot support 26 or 24 effects the forced upward movement of the opposite, i.e. selected, foot support 24 or 26. For illustrative purposes, there is shown in FIG. 7 the relative position of the linkage assemblies 44 and 46 when the foot supports 24 and 26 are positioned equidistant from the floor, and there is shown in FIG. 8 the relative position of the linkage assemblies 44 and 46 when the left foot support 24 is positioned at a higher elevation than is the right foot support 26. To adjust the elevation of the foot supports 24 and 26 relative to the floor 32, the bar 90 of the pulley assembly 78 can be removed from the post 40 and re-secured thereto by way of any of a number of alternative vertically-disposed holes 120 provided along the length of the post 40.

Figure 9:
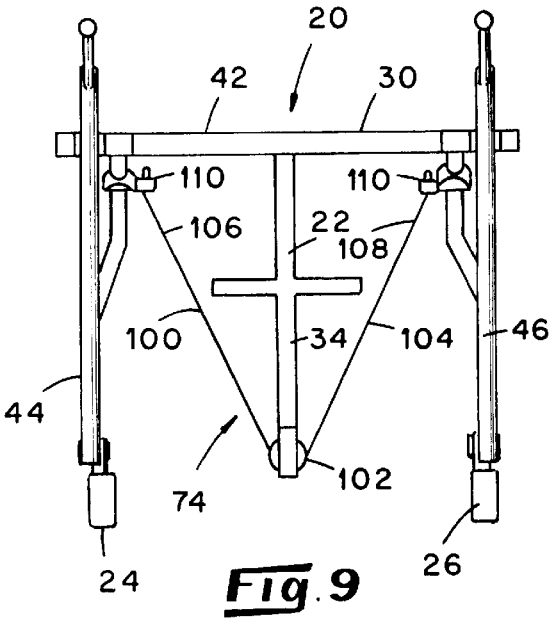
FIG. 9 is a top plan view of the FIG. 1 apparatus showing its linkage assemblies when in one position relative to the base.
Figure 10:
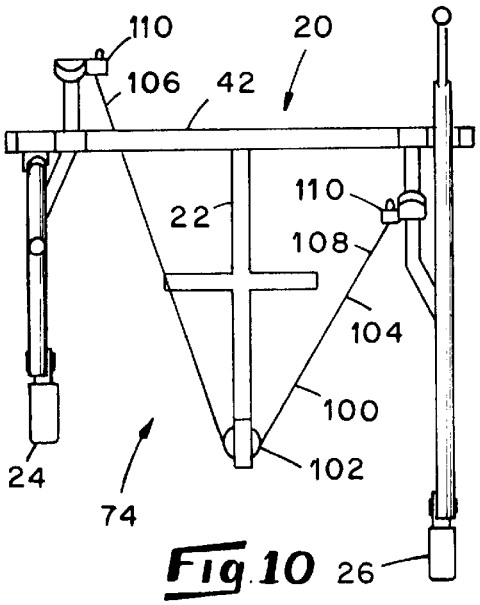
FIG. 10 is a view similar to that of FIG. 9 wherein the apparatus is shown with its linkage assemblies in another position relative to the base.

As best shown in FIGS. 9 and 10, the second coordinating means 74 includes a tension assembly 100 including a second cable and pulley arrangement comprising a pulley 102 journaled to the main bar 34 of the lower section 28 of the base 22 and a cable 104 having two opposite ends 106 and 108. Each end 106 or 108 of the cable 104 is fixedly secured to a corresponding linkage assembly 44 or 46 (by way of a boss 110) adjacent the location at which the bars 64 and 66 are pivotally joined to one another. In the depicted embodiment 20, each boss 110 is integrally joined to the bar 64 of a corresponding linkage assembly 44 or 46. The pulley 102 is journaled to the end of the main bar 34 of the base 22 adjacent the rearward end thereof and is arranged relative to the main bar 34 so that its rotation axis is oriented vertically.

Between the ends 106, 108 of the cable 104, the cable 104 is routed through the pulley 102 so that rearward movement of the left linkage assembly 44 effects a forward movement of the right linkage assembly 46, and the rearward movement of the right linkage assembly 46 effects a forward movement of the left linkage assembly 44. Consequently, the rearward movement of a selected one of the foot supports 24 or 26 by, for example, a rearward shift of the corresponding foot during an exercise routine during which the feet of a user simulate those of a cross-country skier, effects the forced forward movement of the other foot support 26 or 24. Similarly, the rearward movement of the other foot support 26 or 24 by, for example, a rearward shift of the corresponding foot during an exercise routine, effects the forced forward movement of the opposite foot support 24 or 26. For illustrative purposes, there is shown in FIG. 9 the relative position of the linkage assemblies 44 and 46 when the foot supports 24 and 26 are positioned equidistant from (a vertical plane containing) the horizontal bar 42, and there is shown in FIG. 10 the relative position of the linkage assemblies 44 and 46 when the left foot support 24 is positioned forwardly of the right foot support 26.

Figure 11:
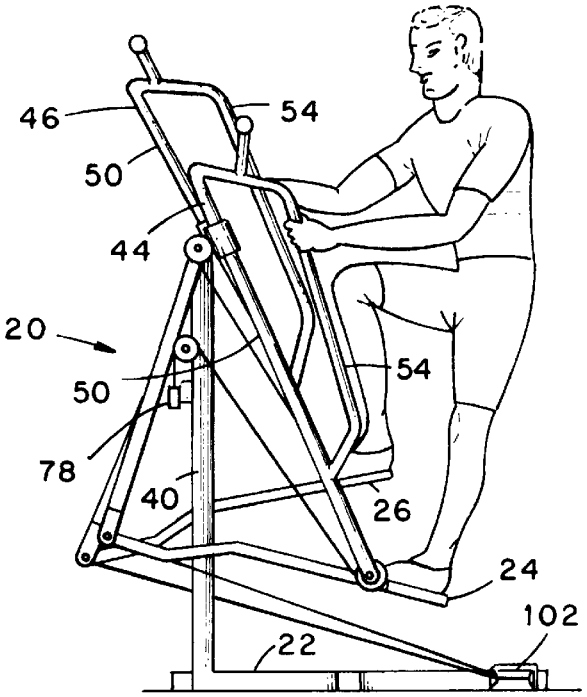
FIG. 11 is a perspective view of the FIG. 1 apparatus shown being used during an exercise routine.

It follows from the foregoing that since the foot supports 24 and 26 are forced to move in concert with one another when either foot support 24 or 26 is moved within its vertical plane along either a horizontal or vertical direction, the foot supports 24 and 26 also move in concert with one another as the foot supports 24 and 26 are moved in non-linear, such as circular, paths. For example and has been discussed above, the linkage assemblies 44 and 46 enable each foot support 24 or 26 to be moved within its vertical plane along a substantially circular path, and this permitted movement enables the apparatus 22 to be used as a cycle-type exercise device as the user stands upon the foot supports 24 and 26 (as illustrated in FIG. 11) and moves his feet along paths resembling those of a cyclist. Furthermore, the coordinating means 70 ensures that one foot support 24 or 26 is in motion when the other foot support 26 of 24 is in motion, and vise-versa.

In addition to the aforedescribed vertical (i.e. upward and downward) motion of the foot supports 24 and 26 (whose motion enables the user to simulate those involved in a stair-climbing exercise) and the aforedescribed back and forth motion of the foot supports 24 and 26 (whose motion enables the user to simulate those involved in a ski-type exercise), it has been found that the user of the apparatus 20 can move the foot supports with his feet to simulate normal walking motion or to simulate jogging motion. During any of these exemplary exercises, the user holds the grip section 54 of the arm 50 of each linkage assembly 44 or 46 (as shown in FIG. 11) to help maintain his balance upon the foot supports 24 and 26 and to facilitate, through his arms, the appropriate motion (e.g. pivotal and sliding) of the linkage assemblies 44 and 46 during the desired exercise routine.

Figure 12:
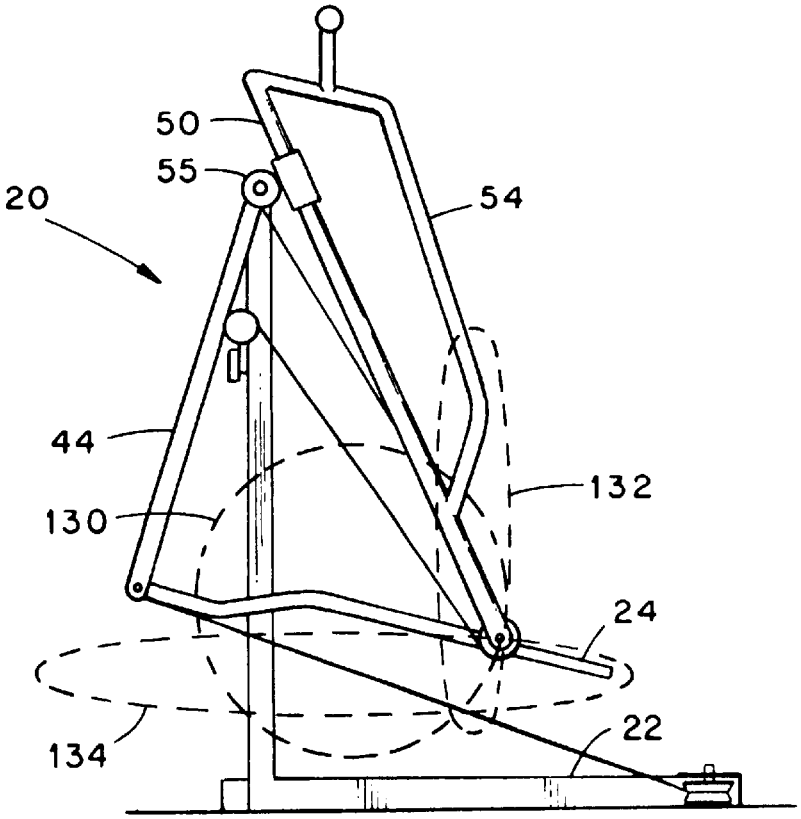
FIG. 12 is a schematic side elevational view of the FIG. 1 apparatus as seen generally from the left in FIG. 1.

For purposes of illustration, there is shown in FIG. 12 a side view of the apparatus 20 various exemplary paths along which each foot support can be moved during use of the apparatus 20. If, for example, the apparatus 20 is used as a cycle-type device, the foot support 24 or 26 can travel along a circular path similar to the path 130. By comparison, if the apparatus 20 is used as a stair-climbing device, the foot support 24 or 26 can travel along a somewhat vertically-disposed oval, or elliptical, path similar to the path 132, and if the apparatus 20 is used as a walking exercise device, the foot support 24 or 26 can travel along a somewhat horizontally-disposed oval, or elliptical, path similar to the path 134.

The apparatus 20, with its aforedescribed coordinating means 70, is advantageous in that it renders movements of the foot supports 24 and 26 fluid-like and devoid of periods of use during which the user's limbs might be exposed to sudden shock forces. For example, as a jogger runs along a road, his legs are commonly exposed to sudden shock forces as his feet strike the road. If, instead, the jogger were to simulate jogging motion upon the apparatus 20, the transfer of weight from one foot to the other foot is much more gradual (or fluid-like) and devoid of the shock forces that would otherwise be experienced by the sudden impact of his feet against the road.

Figure 13:
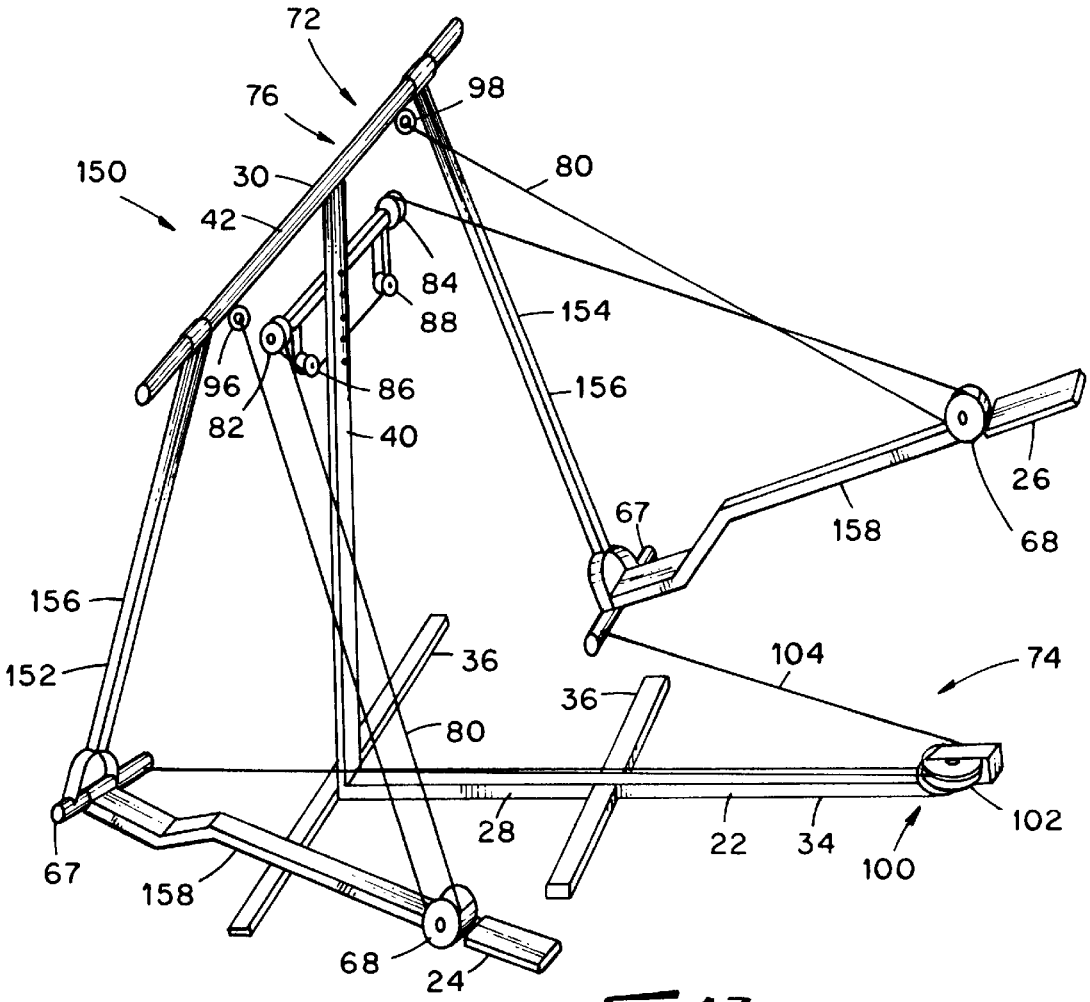
FIG. 13 is a perspective view of another apparatus within which features of the present invention are embodied.
Figure 14:
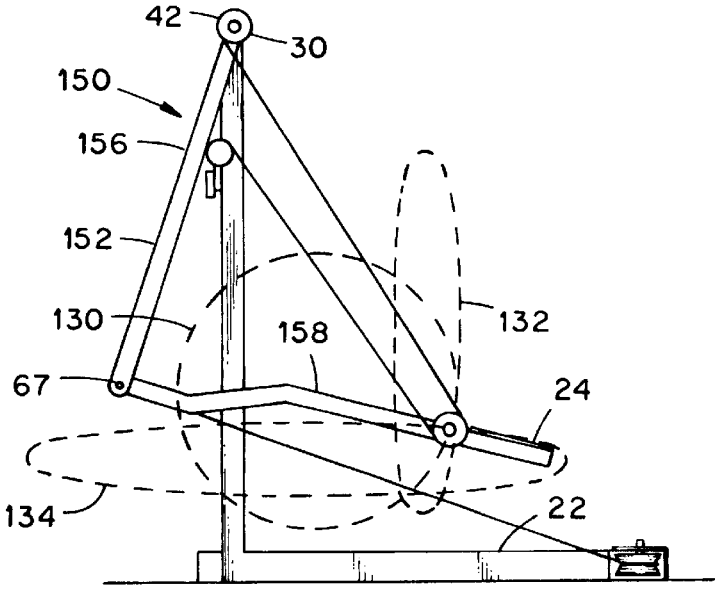
FIG. 14 is a schematic elevational view of the FIG. 14 apparatus as seen generally from the left in FIG. 14.

With reference to FIGS. 13 and 14, there is shown another embodiment, generally indicated 150, of an exercise apparatus within which features of the present invention are embodied. The apparatus 150 is similar in structure to that of the apparatus 20 of FIGS. 1–12 except that the apparatus 150 includes no arm member which corresponds to the sliding arm member 50 (of the left and right linkage assemblies 44 and 46) of the apparatus 20. The components of the apparatus 150 of FIGS. 13 and 14 which correspond to the apparatus 20 of FIGS. 1–12 accordingly bear the same reference numerals.

Therefore, the apparatus 150 of FIGS. 13 and 14 includes only two (i.e. left and right) linkage assemblies 152 and 154 which are each comprised of two elongated members 156, 158 which are each connected to the base 22 in the manner shown. More specifically, within each linkage assembly 152 or 154, the elongated members 156 and 158 are pivotally joined to one another at one end thereof by way of a pivot pin 67, and the end of the elongated member 156 opposite the pivot pin 67 is rotatably secured to the horizontal member 42 of the elevated section of the base 22. Each foot support 24 or 26 is rigidly joined to the end of the elongated member 158 opposite the pivot pin 67 for movement therewith. The apparatus 150 utilizes first and second coordinating means 72, 74 (including tension assemblies 76, 100 comprising first and second cable and pulley arrangements) which are identical to those described above in connection with the apparatus 20 of FIGS. 1–12.

Within the apparatus 150, substantially the entire weight of the foot supports 24 and 26, and any user standing thereon, are transferred to the base 22 by way of the tension assembly 76 (including the first cable and pulley arrangement). In other words, as a user stands upon the foot supports 24 and 26 and/or shifts his weight back and forth between the foot supports 24 and 26, the sum of the weight borne by the foot supports 24 and 26 is substantially equal to the total amount of the weight transferred to the base 22 by way of the cable 80 of the tension assembly 76. To enable the user to maintain his balance upon the foot supports 24 and 26 as he stands thereon or shifts his weight therebetween, the user can hold onto the horizontal member 42 of the base 22.

Even without any member comparable to the sliding arm member 50 of the apparatus 20 of FIGS. 1–12, the foot supports 24 and 26 of the apparatus 150 of FIGS. 13 and 14 are capable of duplicating any movement of the foot supports 24 and 26 of the apparatus 20. In other words and with reference to FIG. 13, there are shown various exemplary paths along which each foot support 24 and 26 can be moved during use of the apparatus 150. If, for example, the apparatus 150 is used as a cycle-type device, the foot support 24 or 26 can travel along a circular path similar to the path 130. By comparison, if the apparatus 150 is used as a stair-climbing device, the foot support 24 or 26 can travel along a somewhat vertically-disposed oval, or elliptical, path similar to the path 132, and if the apparatus 150 is used as a walking exercise device, the foot support 24 or 26 can travel along a somewhat horizontally-disposed oval, or elliptical, path similar to the path 134.

Figure 15:
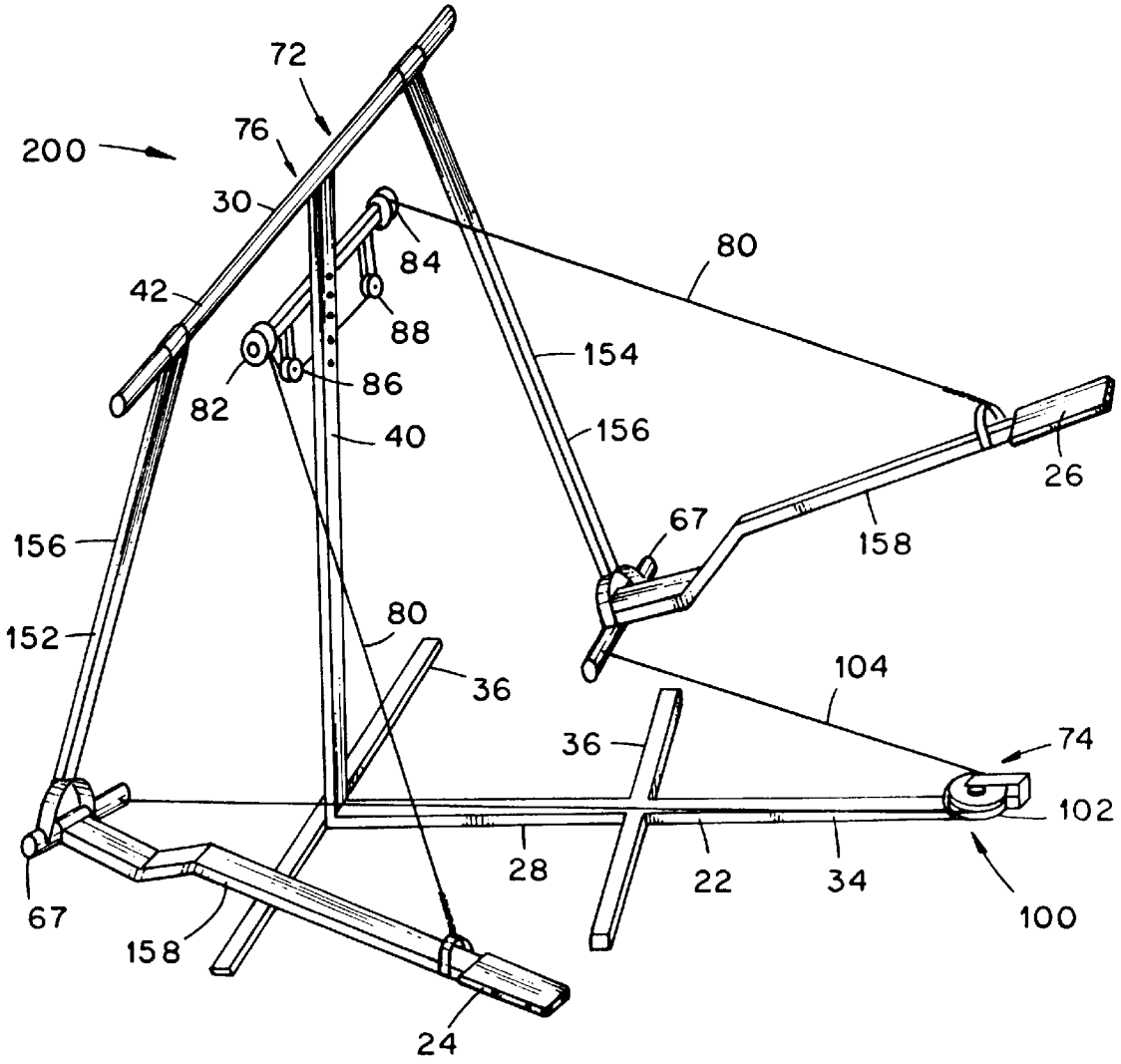
FIG. 15 is a perspective view of still another apparatus within which features of the present invention are embodied.

With reference to FIG. 15, there is shown still another embodiment, generally indicated 200, of an exercise apparatus within which features of the present invention are embodied. The apparatus 200 is similar in structure to that of the apparatus 150 of FIGS. 13 and 14 except that the tension assembly 76 of the apparatus 200 includes no pulleys 68, and the ends of the cable 80 are anchored to the end of the elongated members 158 adjacent the foot supports 24 and 26, rather than to the horizontal member 42 of the base 22. The components of the apparatus 150 of FIGS. 13 and 14 which correspond to the apparatus 20 of FIGS. 1–12 accordingly bear the same reference numerals. Even though the FIG. 15 apparatus is devoid of pulleys 68 and its cable 80 is shorter than that of the apparatus 150 of FIGS. 12 and 13, the foot supports 24 and 26 of the apparatus 200 of FIG. 15 is capable of duplicating any movement of the foot supports 24 and 26 of the apparatus 150.

It follows from the foregoing that an exercise apparatus has been described which includes foot supports 24 and 26 which are each movable in two-coordinate directions (corresponding with any direction permitted in a substantially vertical plane) relative to a base 22 and which are joined to one another in such a manner that movement of one foot support 24 or 26 effects movement of the other foot support 26 or 24. In addition, the permitted movement of each of the foot supports 24 and 26 within a corresponding vertical plane permits the user to simulate stair-climbing motions, skiing motions, walking and jogging motions, and cycling motions.

Figure 16:
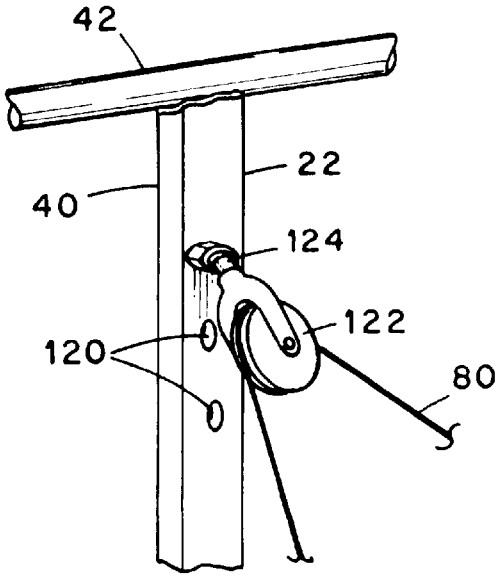
FIG. 16 is a perspective view of an alternative pulley arrangement capable of being used with the apparatus of FIG. 1.

It will be understood that numerous modifications and substitutions can be had to the aforedescribed embodiments 20 and 150 without departing from the spirit of the invention. For example, although the aforedescribed pulley assembly 78 of the apparatus 20 has been shown and described as including four pulleys 82, 84, 86 and 88 wherein each pulley is adapted to rotate about a stationary axis, the pulley assembly 78 with its multiple pulleys may be exchanged for a single pulley. For example, there is shown in FIG. 16, a single pulley 122 which is mounted upon a swivel 124 which, in turn, is attached to the base 22 (in place of the pulley assembly 78). Because the swivel 124 permits the pulley 122 to move in any of three coordinate directions, the pulley 122 effectively self-adjusts in position during the movement of the foot supports during use. Accordingly, the aforedescribed embodiments are intended for the purpose of illustration and not as limitation.

We claim:

1. An exercise apparatus comprising:

a base having a front;

a pair of foot supports joined to the base in a manner which accommodates a movement of each foot support relative to the base between forward and rearward positions and which accommodates a movement of each foot support relative to the base between raised and lowered positions;

coordinating means associated with the base and joined between the foot supports for coordinating the movement of the foot supports between forward and rearward positions so that movement of one foot support relative to the base in one of a forward and rearward direction effects a corresponding movement of the other foot support relative to the base in the other of the forward and rearward direction so that neither foot support can be moved in one of the forward and rearward directions without effecting a corresponding movement of the other foot supports in the other of the forward and rearward direction and for coordinating the movement of the foot supports between raised and lowered positions so that movement of one foot support relative to the base in one of an upward and downward direction effects a corresponding movement of the other foot support relative to the base in the other of the upward and downward direction so that neither foot support can be moved between the raised and lowered positions without effecting a corresponding movement of the other foot support between the raised and lowered positions; and said coordinating means includes a first cable and pulley arrangement joined between the base and the foot supports for coordinating the movement of the foot supports between forward and rearward positions as aforesaid and further includes a second cable and pulley arrangement joined between the base and the foot supports for coordinating the movement of the foot supports between the raised and lowered positions as aforesaid.

2. The apparatus as defined in claim 1 wherein the base has a lower section adapted to rest upon an underlying support surface and an elevated section joined to so as to be elevated above the underlying support surface, and the apparatus includes means interposed between each foot support and the elevated section for joining each foot support to the elevated section to accommodate a pivotal movement of each foot support relative to the elevated section between forward and rearward positions and to accommodate a movement of each foot support relative to the elevated section between raised and lowered positions.

3. The apparatus as defined in claim 2 wherein the interposed means includes a linkage assembly interposed between each foot support and the elevated section wherein each linkage assembly includes a first elongated member having one end which is pivotally joined to the elevated section for pivotal movement relative thereto and a second elongated member having one end which is pivotally joined to the first elongated member at the end thereof opposite the one end of the first elongated member; and each of the foot supports is affixed to a corresponding linkage assembly adjacent the end of the second elongated member opposite the one end of the second elongated member so that each foot support can be moved relative to the elevated section as aforesaid by way of its corresponding linkage assembly.

4. The exercise apparatus as defined in claim 3 wherein the base has a lower section and an elevated section and the first cable and pulley arrangement includes a pulley journaled to the elevated section of the base and a first cable which is routed across the pulley and has two sections which each extend generally downwardly toward the end of a corresponding one of the second elongated members opposite its one end so that as a path is traced along the length of the first cable, the pulley which is journaled to the elevated section is disposed between the ends of the second elongated members opposite the one ends thereof.

5. The exercise apparatus as defined in claim 3 wherein the base has a lower section and an elevated section and the second cable and pulley arrangement includes a pulley journaled to the lower section of the base and a cable having two opposite ends which are each anchored to a corresponding linkage assembly, and the cable is routed across the pulley which is journaled to the lower section.

6. The exercise apparatus as defined in claim 3 wherein the base has a lower section and an elevated section and the first cable and pulley arrangement includes a pulley journaled to the elevated section of the base and a first cable which is routed across the pulley which is journaled to the elevated section and has two sections which each extend generally downwardly toward the end of a corresponding one of the second elongated members opposite its one end so that as a path is traced along the length of the first cable, the pulley which is journaled to the elevated section is disposed between the ends of the second elongated members opposite the one ends thereof and the second cable and pulley arrangement includes a pulley journaled to the lower section of the base and a second cable having two opposite ends which are each anchored to a corresponding linkage assembly, and the second cable is routed across the pulley which is journaled to the lower section.

7. An exercise apparatus comprising:

a base having a front;

a pair of foot supports joined to the base to accommodate movement of each foot support relative to the base between forward and rearward positions and to accommodate movement of each foot support relative to the base between raised and lowered positions;

means associated with the base and joined between the foot supports for coordinating the movement of the foot supports between forward and rearward positions so that movement of one foot support relative to the base in one of a forward and rearward direction effects a corresponding movement of the other foot support relative to the base in the other of the forward and rearward direction so that neither foot support can be moved in one of the forward and rearward directions without effecting a corresponding movement of the other foot support in the other of the forward and rearward direction; and means associated with the base and joined between the foot supports for coordinating the movement of the foot supports between raised and lowered positions so that movement of one foot support relative to the base in one of an upward and downward direction effects a corresponding movement of the other foot support relative to the base in the other of the upward and downward direction so that neither foot support can be moved between the raised and lowered positions without effecting a corresponding movement of the other foot supports between the raised and lowered positions;

wherein the base has a lower section adapted to rest upon an underlying support surface and an elevated section joined to so as to be elevated above the underlying support surface, and the apparatus includes means interposed between each foot support and the elevated section for joining each foot support to the elevated section to accommodate the aforesaid movement of each foot support relative to the base between forward and rearward positions and to accommodate the aforesaid movement of each foot support relative to the base between raised and lowered positions and wherein the interposed means includes a linkage assembly interposed between each foot support and the elevated section wherein each linkage assembly includes one and another elongated member having opposite first and second ends wherein said first ends of said one and another elongated members are pivotally joined to one another, and the second end of one elongated member is pivotally joined to the elevated section for pivotal movement relative thereto;

each of the foot supports is affixed to a corresponding linkage assembly adjacent the second end of said another elongated member so that each foot support can be moved relative to the base as aforesaid by way of its corresponding linkage assembly; and the means for coordinating includes a first cable and pulley arrangement connected between the foot supports and the base for coordinating the movement of the foot supports between raised and lowered positions and a second cable and pulley arrangement connected between the foot supports for coordinating the movement of the foot supports between forward and rearward positions.

8. The apparatus as defined in claim 7 wherein the first cable and pulley arrangement includes a pulley which is journaled to the elevated section of the base and a first cable which is routed across the pulley and has two sections which each extend generally downwardly toward the second end of a corresponding one of the another elongated members so that as a path is traced along the length of the first cable, the pulley which is journaled to the elevated section is disposed between the second ends of the second elongated members.

9. The apparatus as defined in claim 7 wherein the first cable and pulley arrangement is adapted to transfer substantially the entire weight of the foot supports and any user standing thereon to the base by way of the elevated section.

10. The exercise apparatus as defined in claim 9 wherein the first pulley and cable arrangement includes a pulley journaled to each linkage assembly adjacent the foot support, another pulley journaled to the elevated section of the base, and a first cable having two opposite ends which are each anchored to the elevated section of the base and routed across the pulley which is journaled to the elevated section and across each of the pulleys which are journaled to the linkage assemblies so that as a path is traced along the length of the first cable, the pulley which is journaled to the elevated section is disposed between the pulleys which are journaled to the linkage assemblies.

11. The exercise apparatus as defined in claim 7 wherein the second cable and pulley arrangement includes a pulley journaled to the lower section of the base and a second cable having two opposite ends which are each anchored to a corresponding linkage assembly, and the second cable is routed across the pulley which is journaled to the lower section.

12. The exercise apparatus as defined in claim 7 wherein the first cable and pulley arrangement includes a pulley journaled to each linkage assembly adjacent the foot support, another pulley journaled to the elevated section of the base, and a first cable having two opposite ends which are each anchored to the elevated section of the base and routed across the pulley which is journaled to the elevated section and across each of the pulleys which are journaled to the linkage assemblies so that as a path is traced along the length of the cable, the pulley which is journaled to the elevated section is disposed between the pulleys which are journaled to the linkage assemblies; and the second cable and pulley arrangement includes a pulley journaled to the lower section of the base and a second cable having two opposite ends which are each anchored to a corresponding linkage assembly, and the second cable is routed across the pulley which is journaled to the lower section.

13. An exercise apparatus comprising:

a base having two opposite sides and a front and having a elevated section and a lower section adapted to rest in a stationary condition upon an underlying support surface;

a pair of foot supports arranged on opposite sides of the base and cooperating with the elevated section thereof in a manner permitting each foot support to be pivoted relative to the elevated section about a substantially horizontal axis to accommodate a forward and rearward movement of each foot support relative to the base between forward and rearward positions; and the pair of foot supports being suspended from the elevated section in a manner permitting each foot support to be raised and lowered relative to the elevated section between raised and lowered positions so that each foot support can be moved through any of a number of locations relative to the base wherein said number of locations are confined generally within a vertical plane; and first coordinating means joined between the foot supports by way of the base for coordinating the forward and rearward movements of the foot supports relative to one another so that neither foot support can be moved forwardly or rearwardly without effecting a corresponding forward or rearward movement of the other foot support; and second coordinating means joined between the foot supports by way of the base for coordinating the upward and downward movements of the foot supports relative to one another so that neither foot support can be moved upwardly or downwardly without effecting a corresponding upward or downward movement of the other foot support; and wherein each of the first and second coordinating means includes a cable and pulley arrangement for joining the foot supports to one another by way of the base so that movement of one foot support effects a corresponding movement of the other foot support as aforesaid.

14. The apparatus as defined in claim 13 including means interposed between each foot support and the elevated section for joining each foot support to the elevated section to accommodate a pivotal movement of each foot support relative to the elevated section between forward and rearward positions and to accommodate a movement of each foot support relative to the elevated section between raised and lowered positions.

15. The apparatus as defined in claim 14 wherein the interposed means includes a linkage assembly interposed between each foot support and the elevated section wherein each linkage assembly includes a first elongated member having one end which is pivotally joined to the elevated section for pivotal movement relative thereto and a second elongated member having one end which is pivotally joined to the first elongated member at the end thereof opposite the one end of the first elongated member; and each of the foot supports is affixed to a corresponding linkage assembly adjacent the end of the second elongated member opposite the one end of the second elongated member so that each foot support can be moved relative to the elevated section as aforesaid by way of its corresponding linkage assembly.

16. The exercise apparatus as defined in claim 13 wherein the first cable and pulley arrangement includes a pulley journaled to the elevated section of the base and a first cable which is routed across the pulley and has two sections which each extend generally downwardly toward the end of a corresponding one of the second elongated members opposite its one end so that as a path is traced along the length of the first cable, the pulley which is journaled to the elevated section is disposed between the ends of the second elongated members opposite the one ends thereof.

17. The exercise apparatus as defined in claim 13 wherein the second cable and pulley arrangement includes a pulley journaled to the lower section of the base and a cable having two opposite ends which are each anchored to a corresponding linkage assembly, and a second cable is routed across the pulley which is journaled to the lower section.

18. The exercise apparatus as defined in claim 13 wherein the first cable and pulley arrangement includes a pulley journaled to each linkage assembly adjacent the foot support, another pulley journaled to the elevated section of the base, and a first cable having two opposite ends which are each anchored to the elevated section of the base and routed across the pulley which is journaled to the elevated section and across each of the pulleys which are journaled to the linkage assemblies so that as a path is traced along the length of the first cable, the pulley which is journaled to the elevated section is disposed between the pulleys which are journaled to the linkage assemblies; and the second cable and pulley arrangement includes a pulley journaled to the lower section of the base and a second cable having two opposite ends which are each anchored to a corresponding linkage assembly, and the second cable is routed across the pulley which is journaled to the lower section.

* * * * *